US010124465B2

(12) United States Patent
Undén

(10) Patent No.: US 10,124,465 B2
(45) Date of Patent: Nov. 13, 2018

(54) PNEUMATIC POWER TOOL WITH AN OVER-SPEED SAFETY DEVICE

(71) Applicant: ATLAS COPCO INDUSTRIAL TECHNIQUE AB, Stockholm (SE)

(72) Inventor: Björn Gustav Undén, Enskede (SE)

(73) Assignee: Atlas Copco Industrial Technique AB, Stockholm (SE)

( * ) Notice: Subject to any disclaimer, the term of this patent is extended or adjusted under 35 U.S.C. 154(b) by 616 days.

(21) Appl. No.: 14/786,267

(22) PCT Filed: Apr. 30, 2014

(86) PCT No.: PCT/EP2014/058833

§ 371 (c)(1),
(2) Date: Oct. 22, 2015

(87) PCT Pub. No.: WO2014/180730

PCT Pub. Date: Nov. 13, 2014

(65) Prior Publication Data

US 2016/0059379 A1 Mar. 3, 2016

(30) Foreign Application Priority Data

May 8, 2013 (SE) ..... 1350572

(51) Int. Cl.
*B24B 47/26* (2006.01)
*B24B 23/02* (2006.01)
*B25F 5/00* (2006.01)

(52) U.S. Cl.
CPC ..... *B24B 47/26* (2013.01); *B24B 23/026* (2013.01); *B24B 23/028* (2013.01); *B25F 5/001* (2013.01)

(58) Field of Classification Search
CPC ..... B24B 47/26; B24B 23/026; B24B 23/028; B25F 5/001

(Continued)

(56) References Cited

U.S. PATENT DOCUMENTS 3,767,332 A * 10/1973 Wickham ..... B24B 55/00 137/57
3,930,764 A * 1/1976 Curtiss ..... F01B 25/06 137/50

(Continued)

FOREIGN PATENT DOCUMENTS

| | | |
|---|---|---|
| EP | 0021434 A1 | 1/1981 |
| EP | 1066920 A2 | 1/2001 |
| SE | 524579 C2 | 8/2004 |

OTHER PUBLICATIONS

International Search Report (ISR) dated Aug. 21, 2014 issued in International Application No. PCT/EP2014/058833.

*Primary Examiner* — Michelle Lopez
(74) *Attorney, Agent, or Firm* — Holtz, Holtz & Volek PC

(57) ABSTRACT

A pneumatic power tool includes: a housing with a pressure air inlet passage, a rotation motor, a working implement carrying output shaft, and an over-speed safety device including: a valve element located in the inlet passage and shiftable between open and closed positions, a motor speed responsive actuating mechanism which can shift the valve element from an open to a closed position as motor speed reaches an accepted maximum limit, and a retaining unit which maintains the valve element in an open position at normal motor speed levels and releases it toward the closed position when actuated by the actuating mechanism. The retaining unit includes: a latch spindle having varying width in an axial direction and coupled to the actuating mechanism for displacement between valve element locking and releasing positions at the maximum speed limit, and a support surface and axially adjacently located one or more waist portions.

8 Claims, 2 Drawing Sheets

(58) Field of Classification Search
USPC ..... 173/168–169, 2
See application file for complete search history.

(56) References Cited

U.S. PATENT DOCUMENTS

| | | | |
|---|---|---|---|
| 4,371,906 | A | 2/1983 | Alessio et al. |
| 6,393,837 | B1 | 5/2002 | Tomioka |
| 2004/0086374 | A1 | 5/2004 | Elsmark et al. |

* cited by examiner

PNEUMATIC POWER TOOL WITH AN OVER-SPEED SAFETY DEVICE

TECHNICAL FIELD

The invention relates to a pneumatic power tool an over-speed safety device having a rotation motor, and including a means for substantially reducing or completely cutting off the power supply to the motor as the motor speed reaches a predetermined maximum speed limit. In particular, the invention concerns an over-speed safety device for a pneumatic power tool equipped with a speed governor for automatically controlling the pressure air supply to the rotation motor during operation so as to keep the motor speed at a certain suitable work speed level, well below the maximum speed limit. The safety device is intended to become activated automatically in case of malfunction of the speed governor and a following undesired and hazardous increased motor speed.

BACKGROUND AND PRIOR ART

A power tool with a safety device for the above purpose is previously described in SE 524579, wherein the over-speed safety device comprises three main components, namely a speed responsive actuating mechanism, a valve element, and a valve retaining means for maintaining the valve element in open position during normal tool operation. In the above referred over-speed safety device the valve element is a disc-shaped pivotally supported flap type valve, and the retaining means comprises a magnet. At normal operation speed levels the valve element is retained in an open position by magnetic attraction, but at increased speed levels the actuating mechanism forces the valve element out of contact with the magnet whereby the valve element is released and free to move towards closed position to thereby stop or substantially reduce the pressure air supply to the motor.

A problem concerned with over-speed safety devices of the above type is a less reliable function of the valve retaining means. It has turned out to be difficult to obtain an accurate and stable contact between the valve element and the magnet, which means that the retaining force on the valve element has varied individually between different power tools and that the release action of the valve element has been inconsistent. Unintentional activations of the over-speed safety device, for instance, would cause costly working process interruptions. Also the actuating mechanism of the known device for releasing the valve element has turned out to be less reliable and suffered from fatigue problems, which could result in a malfunctioning safety device.

A proper and reliable function of the safety device is of great importance for protecting people and equipment in the vicinity of the work site from injuries and damages in case of a malfunctioning speed governor and a resulting attainment of a hazardous high motor speed levels. In most cases safety devices of this type are provided at power grinders wherein the working implement attached to the motor output shaft is a grinding disc. At motor speed levels exceeding a maximum accepted speed limit there is a risk for explosion/disintegration of the grinding disc with severe damages and injuries of people as a plausible result.

SHORT DESCRIPTION OF THE INVENTION

It is an object of the invention to provide a pneumatic power tool with an over-speed safety device having an improved actuating and valve retaining mechanism that provides for a durable and reliable function.

This object is achieved by means of a pneumatic power tool having a housing with a pressure air inlet passage, a rotation motor, a working implement carrying output shaft, and an over-speed safety device, which comprises: a valve element that is located in the pressure air inlet passage and is shiftable between an open position and a closed position, a motor speed responsive actuating mechanism arranged to accomplish shifting of the valve element from a normally open position to a closed position as the motor speed reaches an accepted maximum speed limit, and a retaining means provided to maintain the valve element in open position at normal motor speed levels and to release the valve element for movement toward the closed position when actuated by the actuating mechanism. The retaining means comprises an axially displaceable latch spindle coupled to the actuating mechanism for being displaced between a valve element locking position and a valve element releasing position at the maximum speed limit, said latch spindle having a varying width in its axial direction including a support surface and one or more waist portions located axially adjacent the support surface, the valve element being provided with one or more protrusions arranged to rest against said support surface to keep the valve element in the open position but to lose contact with said support surface as the latch spindle is axially displaced from its valve element locking position to its valve element releasing position, thereby allowing the protrusions to be received in the one or more waist portions, and thereby releasing the valve element for movement towards the closed position.

In a specific embodiment the valve element is of a disc-shaped flap type pivotally supported in the housing.

In another specific embodiment the valve element is supported on a pivot pin extending perpendicularly to the inlet passage, and said latch spindle extends in parallel with said pivot pin.

In yet another specific embodiment a spring is provided to exert a bias force on the valve element toward the closed position. The spring may however be dispensed with as the pressure air will force the valve element toward the closed position anyway. The spring will make sure the valve element is released.

Further objects and advantages of the invention will appear from the following detailed description.

SHORT DESCRIPTION OF THE DRAWINGS

A preferred embodiment of the invention is described below with reference to the accompanying drawings.

DETAILED DESCRIPTION OF THE SHOWN EMBODIMENT

Figure 1:
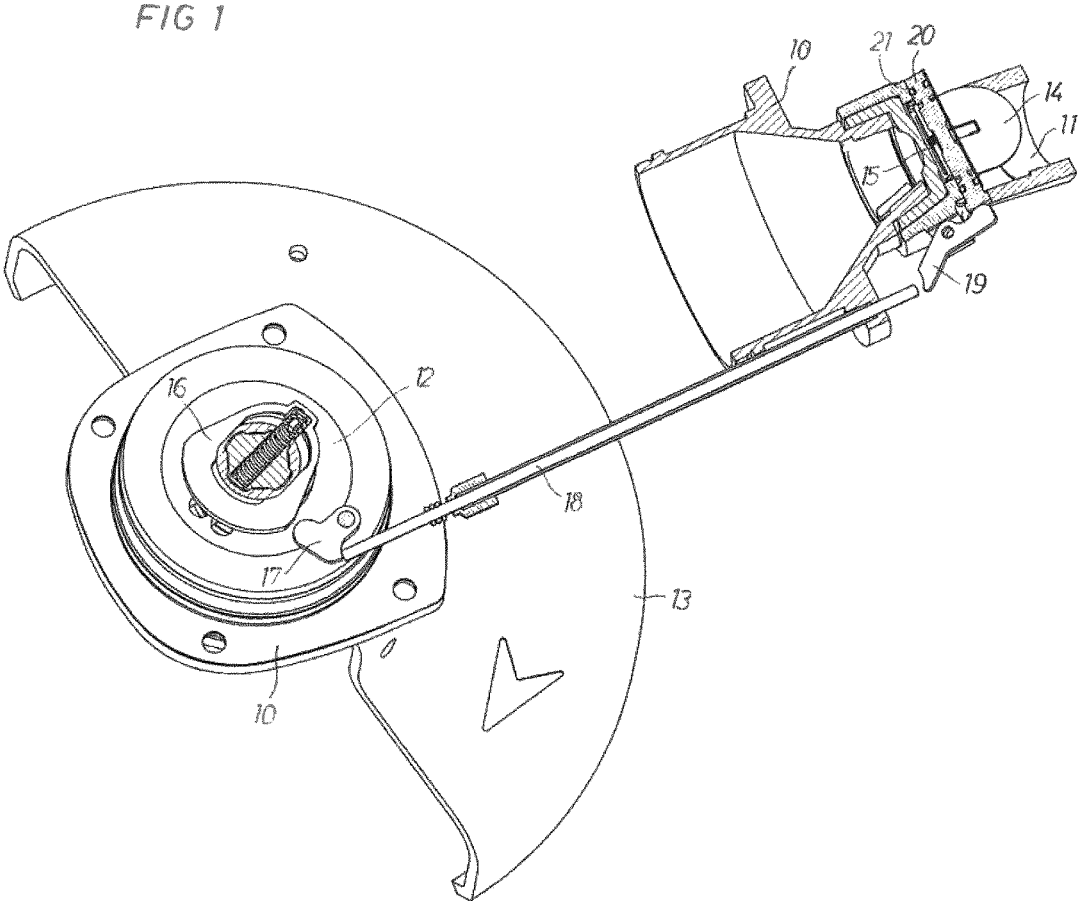
FIG. 1 shows a fractional perspective view of a power tool with an over-speed safety device according to the invention.

The power tool fractionally illustrated in FIG. 1 is a pneumatic grinder with a housing 10 including a pressure air inlet passage 11, a non-illustrated rotation motor with an output shaft 12, and a safety guard 13 intended to partly surround a grinding wheel attached to the output shaft 12. In a conventional way, the motor is provided with a speed governor to automatically control the motor speed to a suitable and safe level. Since the speed governor does not form any part of the invention it is not described any further in this specification.

Figure 2:
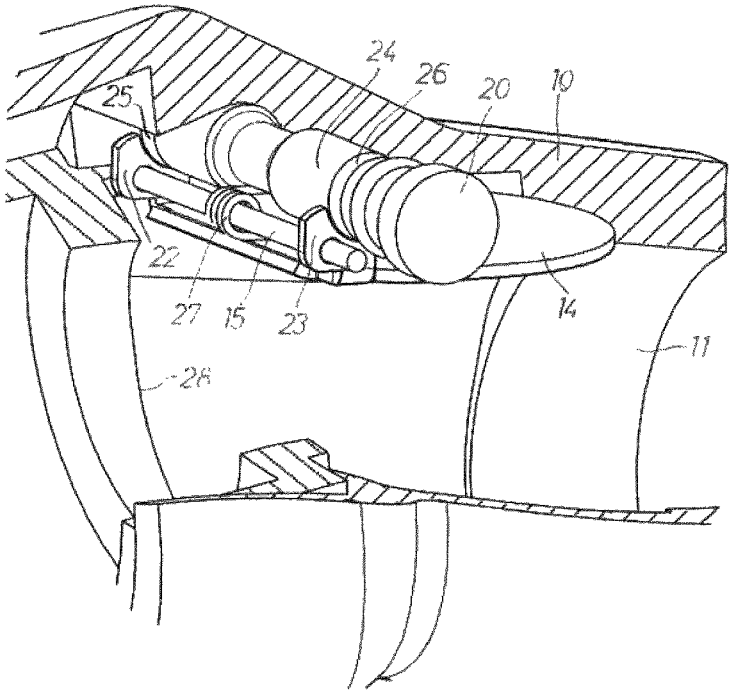
FIG. 2 shows partly in section a perspective view of the over-speed safety device in accordance with the invention illustrating the valve element in open position.
Figure 3:
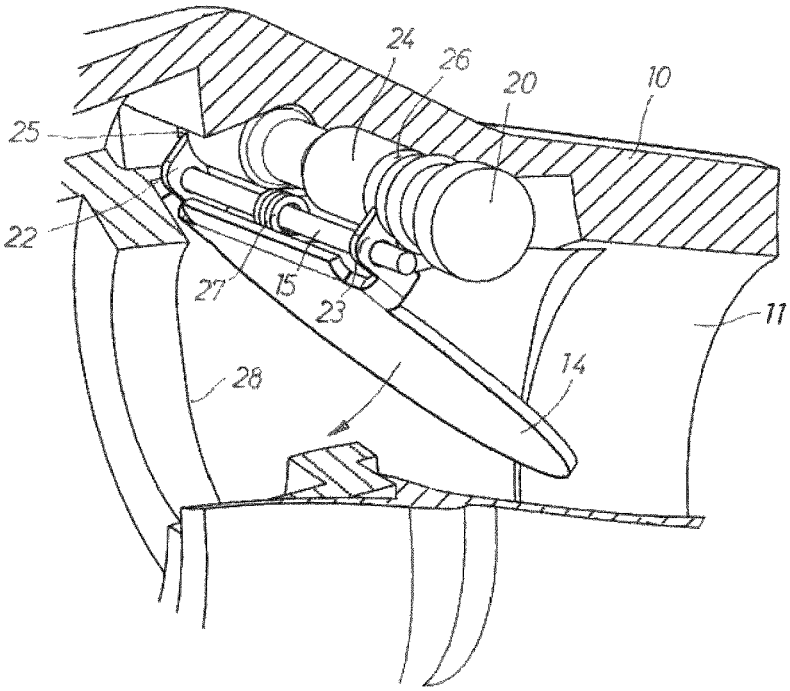
FIG. 3 shows the same view as FIG. 2 but illustrates the valve element in a half way closed position.

The over-speed safety device comprises a valve element 14 located in the inlet passage 11 and supported on a pivot pin 15 and arranged to be shifted between an open position, see FIG. 2, and a closed position. The safety device further comprises a speed responsive actuating mechanism including a spring biased centrifugal weight 16 movably supported on the motor output shaft 12, a movement transition pivot 17, a push rod 18, a lever 19 and a latch spindle 20. The latter is axially displaceable in a bore 21 in the housing 10 between a valve element locking position and a valve element releasing position. The bore 21 extends in parallel with the pivot pin 15 supporting the valve element 14. Moreover, the latch spindle 20 has a cylindrical envelope surface forming a support surface 24 and at least one waist portion 25, 26 being arranged next to the support surface and being formed by circumferential grooves in the spindle 20.

The valve element 14 is a disc shaped flap type valve which is provided with at least one ear or protrusion 22, 23 extending substantially perpendicularly to the valve element 14 and arranged to rest against the support surface 24 on the latch spindle 20 to keep the valve element 14 retained in open position as the latch spindle 20 occupies its valve element locking position. When the latch spindle 20 is axially displaced from the valve element locking position, in which the protrusion(s) 22, 23 of the valve element rest on the support surface 24, to the valve element releasing position the support surface 24 will be translated such that the protrusion(s) 22, 23 will no longer be supported by them. Instead, in the valve element releasing position the protrusions 22, 23 of the valve element 14 are arranged to be received in the waist portions or grooves 25, 26 to thereby allow the valve element 14 to be shifted towards a closed position. A spring 27 exerts a bias force on the valve element 14 in the closing direction of the latter. In its closed position the valve element 14 co-operates with a seat 28 in the housing 10 to cut off or substantially reduce the pressure air supply to the motor.

In normal operation of the power tool the non-illustrated speed governor works properly and the idle speed of the motor is kept down to a desired and safe level where the working process can be performed in an optimum way, i.e. the grinding work is performed efficiently and the wear of the grinding disc is kept down to an acceptable level. However, due to mechanical wear, clogging by debris or damage the speed governor could stop operating properly and the motor speed would no longer be kept down to a safe level but could increase to an hazardous high level where it is a potential risk for the grinding tool to explode/disintegrate and cause severe damage and personal injuries. To prevent the motor speed from increasing above an accepted maximum speed limit the safety device starts coming into action.

At a certain speed level the centrifugal weight 16 in the motor output shaft 12 starts moving radially against the action of its bias spring such that it eventually hits the transition pivot 17 which will act against the push rod 18 to press the latter against and rotate the lever 19 into engagement with the latch spindle 20. As a result of this actuation movement the latch spindle 20 will be displaced from its valve element locking position, as illustrated in FIG. 2, to its release position. Up until now, the valve element 14 has been retained in its open position in that the protrusions 22, 23 have been resting against the support surface 24 of the latch spindle 20, but due to the displacement of the latch spindle 20 to its release position the protrusions 22, 23 will be aligned with and received in the grooves or waist portions 25, 26. This results in that the valve element 14 loses its support by the latch spindle 20 and is free to be shifted towards the closed position thereby assuming co-operation with the seat 28. This shifting movement of the valve element 14 is effectuated partly by the action of the spring 21, but after the valve element 14 has moved to a certain extent the main force to make the valve element 14 shift to the closed position is created by the air flow through the inlet passage. The pressure drop across the valve element 14 is substantial and will cause the valve element 14 to slam against the seat 28 to thereby cut-off the pressure air supply to the motor and stop or at least substantially limit the power tool operation.

The over-speed safety device according to the invention provides a reliable and durable action and guarantees a safe operation of the power tool should the speed governor malfunction.

It is to be understood that the invention is not limited to the described example but can be freely varied within the scope of the invention.

The invention claimed is:

1. A pneumatic power tool comprising:

a housing with a pressure air inlet passage, a rotation motor, a working implement carrying output shaft, and an over-speed safety device, which comprises:

a valve element that is located in the pressure air inlet passage and is shiftable between an open position and a closed position, a motor speed responsive actuating mechanism arranged to accomplish shifting of the valve element from a normally open position to a closed position as the motor speed reaches an accepted maximum speed limit, and a retaining unit provided to maintain the valve element in an open position at normal motor speed levels and to release the valve element for movement toward the closed position when actuated by the actuating mechanism, wherein the retaining unit comprises an axially displaceable latch spindle coupled to the actuating mechanism for being displaced between a valve element locking position and a valve element releasing position at the maximum speed limit, said latch spindle having a varying width in its axial direction including a support surface and one or more waist portions located axially adjacent the support surface, the valve element being provided with one or more protrusions arranged to rest against said support surface to keep the valve element in the open position but to lose contact with said support surface as the latch spindle is axially displaced from its valve element locking position to its valve element releasing position, thereby allowing the protrusions to be received in the one or more waist portions, and thereby releasing the valve element for movement towards the closed position.

2. The pneumatic power tool according to claim 1, wherein the valve element is of a disc-shaped flap type pivotally supported in the housing.

3. The pneumatic power tool according to claim 2, wherein the valve element is supported on a pivot pin extending perpendicularly to the inlet passage, and said latch spindle extends in parallel with said pivot pin.

4. The pneumatic power tool according to claim 3, wherein a spring is provided to exert a bias force on the valve element toward the closed position.

5. The pneumatic power tool according to claim 2, wherein a spring is provided to exert a bias force on the valve element toward the closed position.

6. The pneumatic power tool according to claim 1, wherein the valve element is supported on a pivot pin extending perpendicularly to the inlet passage, and said latch spindle extends in parallel with said pivot pin.

7. The pneumatic power tool according to claim 6, wherein a spring is provided to exert a bias force on the valve element toward the closed position.

8. The pneumatic power tool according to claim 1, wherein a spring is provided to exert a bias force on the valve element toward the closed position.

* * * * *